US008833445B2

(12) United States Patent
Techentien et al.

(10) Patent No.: US 8,833,445 B2
(45) Date of Patent: Sep. 16, 2014

(54) SYSTEMS AND METHODS FOR GRAVEL PACKING WELLS

(75) Inventors: Bruce Wallace Techentien, Houston, TX (US); Harvey Joseph Fitzpatrick, Jr., Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 459 days.

(21) Appl. No.: 13/217,869

(22) Filed: Aug. 25, 2011

(65) Prior Publication Data

US 2013/0048280 A1 Feb. 28, 2013

(51) Int. Cl.
*E21B 43/04* (2006.01)
*E21B 43/08* (2006.01)

(52) U.S. Cl.
CPC ..... *E21B 43/04* (2013.01); *E21B 43/08* (2013.01)
USPC ..... 166/227; 166/234; 166/205; 166/278; 166/51

(58) Field of Classification Search
USPC ..... 166/51, 278, 227, 233, 234, 205
See application file for complete search history.

(56) References Cited

U.S. PATENT DOCUMENTS

| | | | | |
|---|---|---|---|---|
| 4,945,991 | A | 8/1990 | Jones | |
| 5,113,945 | A | 5/1992 | Cable | |
| 6,298,916 | B1 | 10/2001 | Tibbles et al. | |
| 6,516,881 | B2 * | 2/2003 | Hailey, Jr. | 166/278 |
| 7,373,989 | B2 * | 5/2008 | Setterberg, Jr. | 166/378 |
| 7,984,760 | B2 * | 7/2011 | Haeberle et al. | 166/278 |
| 2005/0087346 | A1 * | 4/2005 | Bixenman et al. | 166/385 |
| 2007/0227727 | A1 | 10/2007 | Patel et al. | |
| 2009/0025923 | A1 | 1/2009 | Patel et al. | |
| 2010/0314109 | A1 | 12/2010 | Garcia et al. | |
| 2011/0073308 | A1 * | 3/2011 | Assal et al. | 166/278 |

OTHER PUBLICATIONS

International Patent Application No. PCT/US2012/049286, "International Search Report and Written Opinion Received", Feb. 14, 2013, (10 pages).
Bryant, et al., "Completion and Production Results from Alternate-Path Gravel-Packed Wells," SPE Drilling Completion, Sep. 1995 (6 pages).
Jones, et al., "Gravel Packing Horizontal Wellbores with Leak-Off Using Shunts," Society of Petroleum Engineers, Inc., 1997, (7 Pages).
Hecker, et al. "Reducing Well Cost by Gravel Packing in Nonaqueous Fluid," Society of Petroleum Engineers, Inc., 2004 (7 pages).
Jones, "Spectacular Wells Result from Alternate Path Technology," Well Productivity, (2009) (6 pages).
"Achieve Incremental Flow Control Throughout Your Entire Wellbore," Halliburton, 2008 (1 page).
"EquiFlow® Inflow Control Devices," Halliburton, 2009 (2 pages).
"PetroGuard™ Wrap Screen," Halliburton, 2009 (2 pages).

* cited by examiner

*Primary Examiner* — Kenneth L Thompson
(74) *Attorney, Agent, or Firm* — Kilpatrick Townsend & Stockton LLP

(57) ABSTRACT

Assemblies, systems, and methods to facilitate gravel packing of a wellbore having a flow restricting device are described. The assemblies, systems, and methods can include a flow restricting device and an alternative-path gravel packing system to provide a gravel pack about the flow restricting device. The assemblies, systems, and methods can allow uniform and complete annular sand control pack placement together with reduced flow of unwanted fluids.

20 Claims, 4 Drawing Sheets

SYSTEMS AND METHODS FOR GRAVEL PACKING WELLS

TECHNICAL FIELD OF INVENTION

The present invention relates generally to equipment and procedures used in conjunction with subterranean wells, and more particularly (although not necessarily exclusively), to an assembly, a system, and a method for gravel packing with a flow restricting device.

BACKGROUND

Some wells can be completed with sand control screens for controlling sand production. Other wells can additionally have a gravel pack placed around the screens to control sand production. Produced sand is undesirable for many reasons. The sand is abrasive to components within a well and must be removed from the produced hydrocarbon fluids at the surface.

For a complete gravel pack, it is often preferred to completely pack an annulus external to production tubing across a sand face or external to a sand screen without leaving any voids. Failure to obtain a complete gravel pack can result in lower productivity and/or sand-producing gravel pack. This incomplete packing is often associated with the formation of sand bridges in the interval to be packed. Sand bridges can prevent placement of sufficient sand along a screen on the opposite side of the bridge.

Different methods of gravel packing are available. One method can be referred to as using an alpha-beta technique or sand duning technique. In those methods, a sand concentration or sand slurry can be pumped into the well system. The sand slurry can exit a gravel pack port and build a dune or collection along a portion of a screen. As the fluid continues to flow past the dune at a certain velocity, the top of the dune is removed. The alpha wave, which progresses along the wellbore, includes gravel that can be deposited by gravity on the bottom side of the annulus around a screen, a blank pipe, a workstring, or other conduit.

The presence of gravel slurry flowing in the annulus combined with the force of gravity can often cause some gravel to fall and accumulate on the floor of the annulus for wells with horizontal deviations. The slurry flow velocity above the gravel dune can cause shear force sufficient to wash away higher accumulations of gravel. The shear forces of the slurry fluid flow can cause the gravel accumulation to reach a equilibrium gravel dune height in the annulus. The duning process can continue as the slurry flow velocity in the annulus is sufficient to cause enough shear force to prevent gravel accumulation. Once axial slurry flow is reduced to a level that is inadequate to shear away gravel at the top of a dune, the slurry flow along the annulus can be blocked. At such blocking, the alpha wave gravel placement can be terminated. Fluid exiting the annulus prior to the end of the screen may prevent the alpha wave from progressing uniformly to the end of the screen. The beta wave then fills up the downstream portion of the well as the sand moves its way upstream as it piles up along the length of the well. Uniform beta packing often occurs when the fluid can flow into the screen in a uniform manner along its length. However, in some well systems, the alpha wave may not reach an end of the wellbore, thus stalling at an intermediate portion of the wellbore due to a number of factors, such as the loss of fluid velocity or fluid lost to the formation. The result may be an incomplete pack.

An alternate approach can include replacing the use of a beta wave gravel deposition by adding additional gravel deposit height in the annulus using one or more successive alpha wave deposit phases of gravel packing. Gravel placement with alpha wave deposition can be uniform and continuous up to the point where gravel slurry carrier fluid flow velocity exterior to the screen is sufficient to transport gravel along the length of the screen. Conditions that can preclude uniform and continuous gravel placement by alpha wave deposition include irregularities in the wellbore diameter or excessive hole rugousity, excessively high or inconsistent gravel concentration per unit volume of slurry, and slurry flow velocities which are either too high or too low.

Some well systems can be gravel packed using alternate-path gravel packing. In some well systems, the alternate-path gravel packing can use shunt tubes or other bypass flow paths to provide a complete gravel pack.

In a well designed conventional gravel pack screen and tool assembly, the fluid flow paths and cross sectional areas may be arranged such that in some cases, a substantially complete gravel packing using both alpha wave and beta wave or multiple alpha wave gravel placement may be obtained. However, difficulty in the art has arisen when gravel packing wellbores employing screens with flow management devices. Some such well bores and/or completions can employ flow restricting devices, such as an inflow control device, an autonomous valve, or screens that have means of controlling fluid inflow at isolated points along the screen. The introduction of such inflow control devices can provide difficulties in obtaining a complete gravel pack about a screen of the well system. Such isolated points of fluid ingress through a screen may prevent uniform packing during the beta wave gravel depositing phase of the alpha wave and beta wave packing process.

In some well systems, the inflow control device may impair or prevent a successful placement of the gravel pack around the screen when using these conventional slurry pumping techniques. In some cases, the inflow control device can restrict the available flow rate through the screen during the gravel packing operation. As a result, few (if any) wells have been completed having an integral flow control device with a complete and uniform gravel pack installed about the screen.

Therefore, assemblies and systems are desirable that can provide an open hole gravel pack in well completions having a flow restricting device and screen, particularly in horizontal well completions.

SUMMARY

Certain embodiments described herein are directed to assemblies and systems to facilitate gravel packing of a well having a flow restricting device. The assemblies, systems, and methods can be installed in a bore of a subterranean formation.

In some embodiments, the assembly can comprise a well screen, a flow restricting device, and a shunt tube system. The flow restricting device can control fluid flow through the well screen. The shunt tube system can provide an alternative path for gravel slurry about the well screen during a gravel packing operation.

In at least one embodiment, the flow restricting device can comprise an inflow control device.

In at least one embodiment, the flow restricting device can comprise an autonomous valve. In some such embodiments, the autonomous valve can selectively control fluid flow during production or injection of the well.

In at least one embodiment, the shunt tube system can include a transport tube that is fluidly connected to a packing tube. The gravel slurry can exit the shunt tube system through a nozzle in the packing tube.

In at least one embodiment, the shunt tube system can comprise at least one nozzle from which the gravel slurry can be discharged about the well screen.

In at least one embodiment, the shunt tube system can comprise a system capable of gathering carrier fluid. In some such embodiments, the system of gathering carrier fluid can include a gravel screening flow channel, a tube positioned adjacent to the well screen, or a manifold capable of allowing fluid to flow to a fluid sink to allow packing of gravel about the well screen.

In at least one embodiment, the flow restricting device can be interconnected to a completion string.

In at least one embodiment, the shunt tube system can be connected to the flow restricting device.

In other embodiments, a well system can comprise a flow restricting device, a shunt tube system, and a gravel pack. The flow restricting device can control fluid flow between the reservoir and the wellbore. In such embodiments, the flow restricting device can be capable of having a screen positioned in a flow stream or path of the device. In such systems, the shunt tube system can provide an alternative for gravel slurry to flow. The gravel slurry can be deposited about the screen of the flow restricting device during a gravel packing operation.

In at least one embodiment, the flow restricting device of the well system can be interconnected in a completion string.

In at least one embodiment, the flow restricting device of the well system can comprise an inflow control device.

In at least one embodiment, the shunt tube system of the well system can be connected to the flow restricting device.

In yet other embodiments, a method of gravel packing a well is provided. The method can comprise installing a flow restricting device and a screen in a wellbore. The flow restricting device can control the flow of fluid into a reservoir or from a reservoir. The method further comprises flowing a gravel slurry about the flow restricting device and the screen. A portion of the gravel slurry can flow through a shunt tube system. The shunt tube system can provide an alternative path for the gravel slurry to flow along the screen during a gravel packing operation.

In at least one embodiment, the method can comprise installing a plurality of flow restricting devices in a completion string.

In at least one embodiment, the method can include installing a flow restricting device comprising an inflow control device.

These illustrative aspects and embodiments are mentioned not to limit or define the invention, but to provide examples to aid understanding of the inventive concepts disclosed in this application. Other aspects, advantages, and features of the present invention will become apparent after review of the entire application.

DETAILED DESCRIPTION

Figure 1:
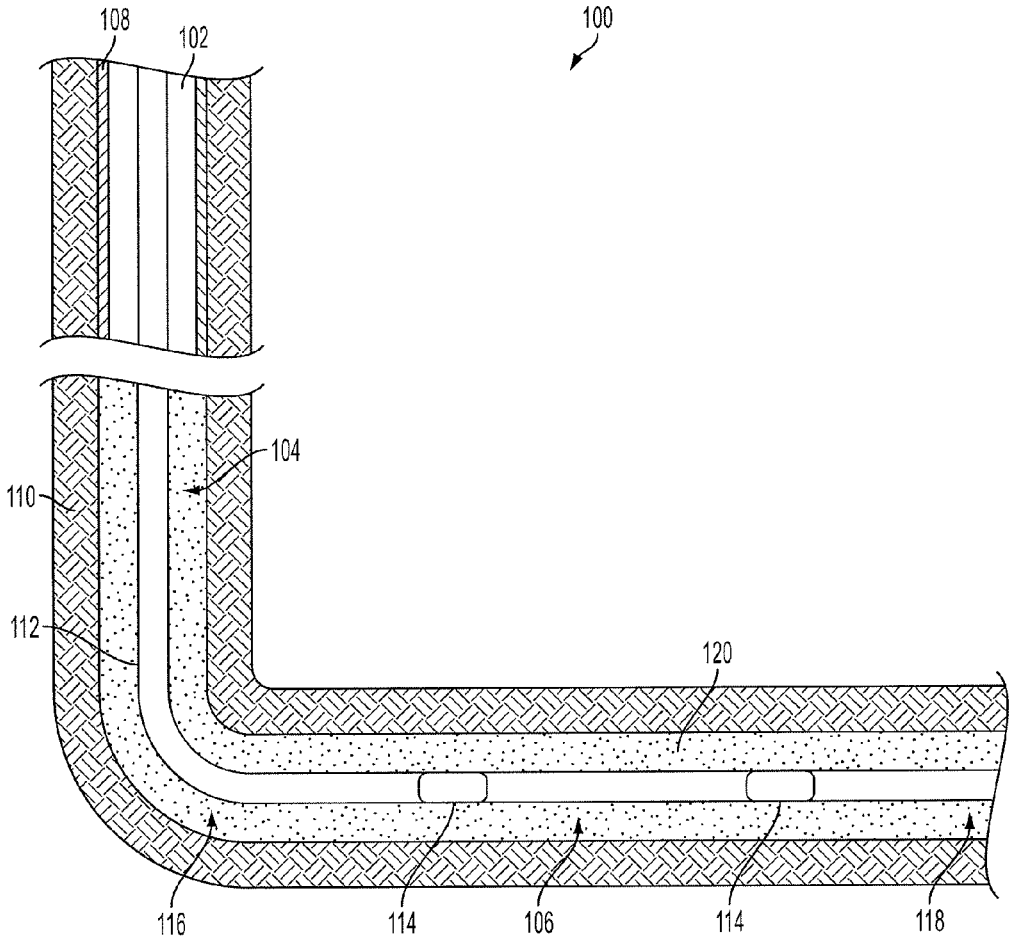
FIG. 1 is a schematic illustration of a well system having an inflow control device assembly according to one embodiment of the present invention.

Certain aspects and embodiments of the present invention relate to systems and assemblies that are capable of being installed in a bore, such as a wellbore, in a subterranean formation for use in producing hydrocarbon fluids from the formation. In some embodiments, the assemblies and systems can include a flow restricting device and an alternate-path gravel packing system to provide a gravel pack about the flow restricting device. In some embodiments, a shunt tube system can be employed to provide an alternative path for gravel slurry during a gravel packing operation. Assemblies, systems, and methods according to some embodiments can allow uniform and complete annular sand control pack placement together with reduced flow of unwanted fluids.

With the increased frequency of the operation of deviated, highly deviated, or horizontal wells, systems and assemblies to provide for a complete gravel pack about flow restricting devices are desired. As used herein, the terms "deviated well" or "highly deviated well" refer to a well or a section of a well that is deviated from a vertical orientation. As used herein, the terms "horizontal well" or "horizontal section of a well" refer to a well or section of a well that is deviated from a vertical orientation in a generally horizontal orientation at an angle from about 60 degrees to about 130 degrees relative to the ground surface. Some embodiments described herein refer to systems, assemblies, or devices that can be utilized in a horizontal well or a horizontal section of well or other wellbores employing screens with flow management devices; although not specifically stated, some of the same such embodiments may be utilized in a deviated or highly deviated well or well section.

In the following description of the representative embodiments, directional terms, such as "above", "below", "upper", "lower", "upstream", "downstream", etc. are used for convenience in referring to the accompanying drawings. In general, "above", "upper", "upstream", and similar terms refer to a direction toward the earth's surface along a well bore and "below", "lower", "downstream" and similar terms refer to a direction away from the earth's surface along the wellbore.

In some embodiments, the systems and methods described herein can facilitate a complete gravel pack of a well system, and particularly in horizontal sections of a well system or wellbores employing screens with flow management devices. In some embodiments, the well system can comprise a flow restricting device that can be used to control fluid flow during production of the well system. While the flow restricting device can control and/or restrict fluid flow into a well system or fluid flow into a reservoir, certain other challenges (for example, challenges during a gravel packing operation) may arise in using the flow restricting device.

Well systems often utilize sand control screens to control sand production. Some of such well systems additionally utilize a gravel pack placed around or about the screens to control sand production further. Typically, gravel packing operations comprise a gravel slurry flowing into an annulus between a completion string and a wellbore. In some embodiments, a well screen can be positioned about the completion string. The resulting gravel pack can be installed about the well screen connected to the completion string.

Multiple techniques and procedures for gravel packing are used in gravel packing operations. Some methods employ different carrier fluids having different viscosities to transport the gravel, for example using a viscous fluid, such as a gel, versus a low-viscosity fluid, such as water. Other methods pump the slurry at different velocities into the systems. Yet other methods utilize an alternate path screens or shunt tubes in the gravel packing operation.

In some methods, a slurry can be pumped down a well system having a screen shunt tube configuration. The shunt tube configuration can provide an open path continuously along the length of a screen. As the slurry passes through the shunt tubes and reaches a point at which the system is not gravel packed, the slurry exits the shunt tubes and forces its way into the incompletely packed volume to further pack the system. In some embodiments, the shunt tubes can provide a complete pack around a screen by pumping a slurry down the shunt tubes to fill in any voids. However, some difficulty may be experienced in gravel packing operations in horizontal wells, as described more fully below.

In horizontal wells or completions, the fluid flowing through the well is subject to variable frictional forces. Typically, the greater the distance a fluid flows along a horizontal completion, the greater the frictional forces that are exerted upon the fluid. In some horizontal completions, a well can have a greater drawdown of fluid at an upstream portion of a well as compared to a downstream portion of a well. In some well systems, the upstream portion of a horizontal section of a well can be referred to as a "heel" and the downstream portion of a horizontal section of a well can be referred to as a "toe." For example, in referring to an embodiment shown in FIG. 1, an upstream portion of the well is shown by a heel region 116 and a downstream portion of the well is shown by a toe region 118.

As the frictional forces exerted upon the fluid at the toe region increases the pressure within the reservoir, the fluid flow of the toe region is impacted and less fluid enters the well system at the toe region. As the wellbore flowing pressure on the interior of the tubular is less in the heel region of the well system (due to lesser amount of friction forces), the fluid flow between the wellbore and the reservoir is greater in the heel region. Often, the result is a non-uniform contribution and differential influx of fluid across the horizontal section of the well. Within the horizontal section of the well, it is desired to have uniform contribution of fluid or beneficial influence of fluid flow profile in production or injection along the length of the section. In some cases, the increased friction pressure applied at the heel region can provide increased back pressure on the reservoir flowing pressure at the wellbore. The increased back pressure at the heel region can reduce the driving pressure between the wellbore and the reservoir at the toe region. Such a reduction in driving pressure at the toe region often reduces the fluid flow between the reservoir and the wellbore at the toe region (with respect to the fluid at the heel region which has less back pressure due to fluid flow friction).

In some well systems, flow restricting devices can be utilized to provide a uniform pressure differential between the flowstream in the tubulars and the reservoir. A uniform differential pressure between the flowstream in the tubulars and the reservoir can provide a more uniform drawdown of fluid (as opposed to a non-uniform drawdown, for example, where more fluid is drawn down at the heel region of the well system). By using inflow control devices, the reservoir inflow from a high productivity zone (for example, the heel region) can be reduced while improving inflow from a low productivity zone (for example, the toe region). In some embodiments, inflow control devices can result in a higher frictional loss through a screen at the heel region as compared to the toe region. In some embodiments, the inflow control device can increase resistance at the heel region of the well system. As a result, a more uniform drawdown profile is present, which results in a more uniform contribution of fluid along the length of the horizontal section. The inflow control device may provide a uniform reservoir drawdown pressure along the completion interval. When used in combination with isolation devices to segment the wellbore, inflow control devices can be used to provide more uniform or controlled flux from various portions of the reservoir penetrated by the well.

In some embodiments, the flow restricting device may comprise an inflow control device. In some embodiments, the inflow control device can comprise small diameter tubes or channels to restrict inward flow through a screen. A flow restricting device may be any device capable of restricting flow, including by using tortuous passages, helical flow paths, nozzles, orifices, and/or other flow restricting elements to restrict inward flow through a screen.

Flow-restricting devices according to some embodiments may be "intelligent" in that the device may be remotely controlled and/or the device may be capable of responding to changed downhole conditions to variably restrict inward flow through the screen. In some such embodiments, the device may include a downhole controller that may include a telemetry device for communicating with the surface or another remote location.

In some embodiments, the inflow control device can be employed with a screen. The screen may be incorporated into a screen filter jacket positioned around the inflow control device. During production, reservoir fluid flow can enter through the screen or screen filter jacket and then flow between the filter jacket and a screen base pipe.

Often, there are no holes drilled directly underneath the screen filter jacket in a screen of an inflow control device assembly. The reservoir flow can enter a resistance element of an inflow control device. The resistance element can comprise a tube, choke, or other device causing back pressure to flow. After fluid passes the resistance element, the fluid can then pass through a port from the inflow control device to the interior of the screen base pipe.

In some embodiments, the inflow control device can be interconnected to a completion string. In some embodiments, the inflow control device can be built as a part of the completion string.

Typically, well systems employing an inflow control device rely on a sand screen to control sand production. Such well systems typically do not include gravel pack. The screen acts as the element for sand control instead of using a gravel pack as a reservoir sand filter. Often, such reliance upon the screen can be a result of the challenges resulting in obtaining a complete gravel pack within a horizontal well that incorporates flow restricting devices.

In some embodiments, the flow restricting device can comprise an autonomous valve. In some embodiments, the autonomous valve can provide for selective production. For example, the autonomous valve can comprise a plurality of baffles to exclude water from production, and thus selectively produce oil. The autonomous valve can eliminate or minimize any separation of water and oil fluid at the surface.

Often inflow control device screens, and other screens used with a flow restricting device can hamper or impede packing of gravel fully along the length of the screen. The fluid must be separated from the gravel slurry to allow packing of the gravel around the screen. Screens with restricted or limited flow access to one or a few points, such as ports, tubes, orifices, or valves, tend to separate the gravel from the slurry mainly at the points of fluid loss outside the screen to the screen liner. The fluid suspending the gravel in the pumped gravel slurry typically follows along the path of least resistance. As a result, fluid flow through the screen tends to jump from one fluid loss point to the next while the gravel slurry in-between does not lose its fluid effectively. Often, the result can be that only the portion of the screen adjacent to the fluid flow points can be gravel packed in a way that the gravel pack can then form an effective filter for formation of sand and solids.

For an inflow control device screen or other screen with limited flow access, the gravel pack carrier flow tends to seek passage through the screen filter jacket in close proximity to the inflow control device port in the screen tubular wall. In some embodiments, gravel tends to accumulate near the port. Once the fluid flow resistance through the gravel accumulating near the port is greater than the fluid flow friction required for flow to enter the next path of lower resistance, the packing process may cease at the prior port and skip to the next port. Often the result is that part of the screen does not have a gravel pack to the filter formation solids from fluid passing from the reservoir and into the screen during operation of the well. Such methods can result in an incomplete gravel pack.

In some embodiments of the present invention, an assembly can comprise a flow restricting device and a shunt tube system. The shunt tube system may be mechanically coupled to the inflow control device. In some embodiments, the shunt tube system may be fluidically connected to the flow restricting device. As such, the assembly may provide a device that provides a complete gravel pack about a screen of the inflow control device.

The shunt tube system, or other alternative-path screen systems, can provide an alternative route for fluid to flow resulting in a more complete gravel pack about a screen of the inflow control device.

As described above, the gravel packing process may proceed by skipping from port to port in the presence of an inflow control device. However, once the upstream port area is packed, the packing can proceed to the top of the screen. Once the annulus upstream of the screen is packed, the path of least resistance for the fluid can be through the shunt tube system. The slurry can flow out of a nozzle of the shunt tube system and finish packing the areas left unfilled or partially filled by the initial packing process where the fluid tends to flow from port to port.

In some embodiments, the shunt tube system can have exit or output nozzles positioned along the length of an inflow control device screen. The shunt tube system can feed gravel slurry to the nozzles. The nozzles can be positioned a certain distance apart. In some embodiments, the nozzles may be about 1 to about 2 meters apart. In other embodiments, the nozzles can be positioned at a distance apart to provide sufficient gravel placement over a length of the system.

In some embodiments, the flow restricting device coupled to the shunt tube system can be interconnected to a completion string. The flow restricting device coupled to the shunt tube system may be built as part of the completion string.

In some embodiments, the assemblies can include a dedicated carrier fluid gathering system. In some embodiments, the dedicated fluid gathering systems can include gravel screening flow channels. In some embodiments, the dedicated fluid gathering systems can include a tube or conveyance along the length of the screen, such as a return tube. In yet other embodiments, the dedicated fluid gathering systems can include a manifold to carry fluid to a fluid sink allowing packing of the gravel around the screen.

In some embodiments, the flow restricting device can be an integral part of a screen. For example, the flow restricting device can be installed when the screen is installed in the well system. In some such embodiments, an intervention into the well is not required to install the flow restricting device. In other embodiments, the flow restricting device can be separate from the screen and not depart from the principles described herein. In some embodiments, each joint of a screen can have an inflow control device.

The illustrative examples are given to introduce the reader to the general subject matter discussed herein and not intended to limit the scope of the disclosed concepts. The following sections describe various additional embodiments and examples with reference to the drawings in which like numerals indicate like elements and directional description are used to describe illustrative embodiments but, like the illustrative embodiments, should not be used to limit the present invention.

Referring again to FIG. 1, it depicts a well system 100 with a plurality of inflow control device assemblies 114 according to certain embodiments of the present invention. The well system 100 includes a bore that is a wellbore 102 extending through various earth strata 110. The wellbore 102 has a substantially vertical section 104 and a substantially horizontal section 106. The substantially horizontal section 106 includes a heel region 116 and a toe region 118. The heel region 116 is upstream from the toe region 118

The substantially vertical section 104 includes a casing string 108 cemented at an upper portion of the substantially vertical section 104. In some embodiments, a substantially vertical section may not have a casing string. The substantially horizontal section 106 is open hole and extends through a hydrocarbon bearing subterranean formation 110. In some embodiments, a substantially horizontal section may have casing.

A completion string 112 extends from the surface within the wellbore 102. The completion string 112 can provide a conduit for formation fluids to travel from the substantially horizontal section 106 to the surface or for injection fluids to travel from the surface to the wellbore for injection wells. The substantially horizontal section 106 comprises a plurality of inflow control devices 114. The inflow control device assemblies 114 are interconnected to the completion string 112. A gravel pack 120 is installed about the inflow control devices 114 as well as throughout a portion of the wellbore 102.

FIG. 1 shows an exemplary portion of a well bore comprising embodiments of the present invention. It should be appreciated that any number of inflow control device assemblies 114 can be employed in a well system. Further, the distance between or relative position of each inflow control device assembly can be modified or adjusted to provide the desired production set up.

Figure 2A:
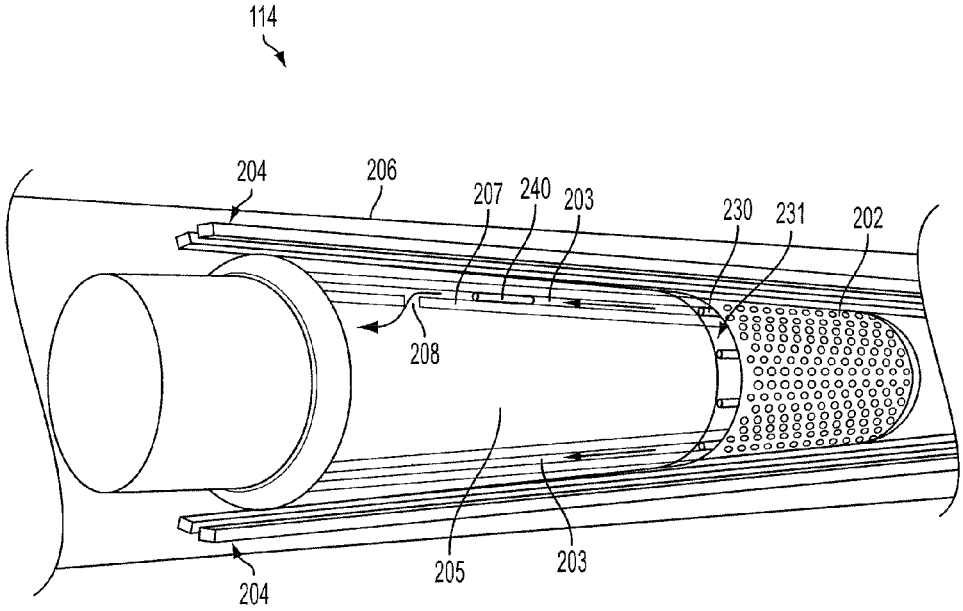
FIG. 2A is a side perspective view of an inflow control device assembly according to one embodiment of the present invention.

FIG. 2A shows an inflow control device assembly 114 according to some embodiments. The inflow control device assembly comprises a screen 202, a channel 203, a shunt tube system 204, an interior 205 of the screen base pipe, and a casing 206. A screen base pipe 207 defines the interior 205 of the screen base pipe. The inflow control device assembly 114 includes wires 230 that are longitudinally oriented along a certain length of the assembly. The wires 230 provide a spacing structure that creates a space 231 between the screen base pipe 207 and the screen 202.

A first port (not shown) can be located behind the portion shown of the screen 202. Fluid flows from the reservoir through the screen 202 and then into the channel 203. The arrows within the channel 203 show the direction of the fluid flow. The fluid passes through the channel 203 into the flow restricting device 240. The fluid then exits the flow restricting device 240 and enters into the interior 205 of the screen base pipe via a port 208.

The shunt tube system 204 comprises two generally rectangular cross-sectional tubes that span the length of the inflow control device assembly 114. Other shapes and configurations of the shunt tube system can be employed without departing from the scope of the invention. The shunt tube system 204 is generally positioned in an annulus between the screen and the formation. In other embodiments shunt tubes may be positioned between the screen base pipe 207 and the screen 202. The shunt tube system 204 can provide an alternative path for gravel slurry to flow during a gravel packing operation. In some embodiments, the shunt tube system 204 can be coupled to the inflow control device assembly 114. In some embodiments, the casing 206 surrounds the shunt tube system 204. In some such embodiments, the casing 206 may be perforated. In other embodiments, the inflow control device assembly 114 may not have an outer casing surrounding the shunt tube system 204.

Figure 2B:
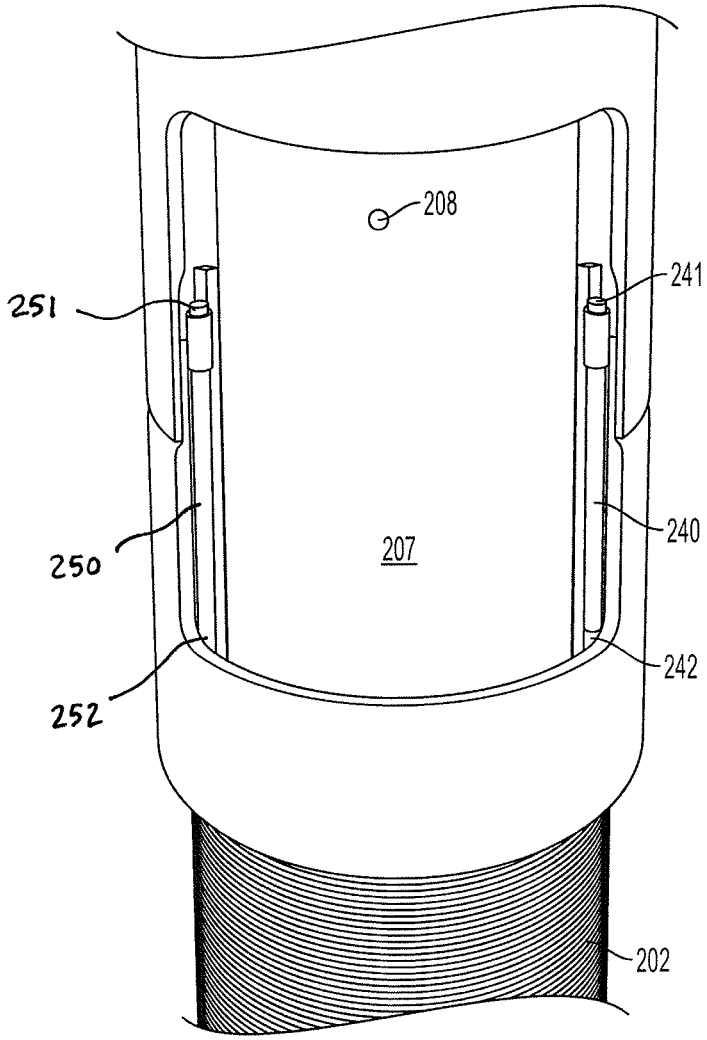
FIG. 2B is a side view of an inflow control device according to one embodiment of the present invention.

FIG. 2B shows a side view of a section of an inflow control device assembly according to one embodiment described herein. The inflow control device assembly has a screen 202 through which fluid may enter from the reservoir. A first manifold is positioned in proximity to a first end 242 of the flow restricting device 240 and a first end 252 of the flow restricting device 250. The first manifold directs fluid flow into the flow restricting devices 240, 250. Fluid then passes through resistance elements 241, 251 within the flow restricting devices 240, 250 and the exits the flow restricting devices 240, 250 to a second manifold which directs fluid flow to channel or annulus surrounding the screen base pipe 207. Fluid then flows through the port 208 into the interior of the screen base pipe 207.

Figure 3:
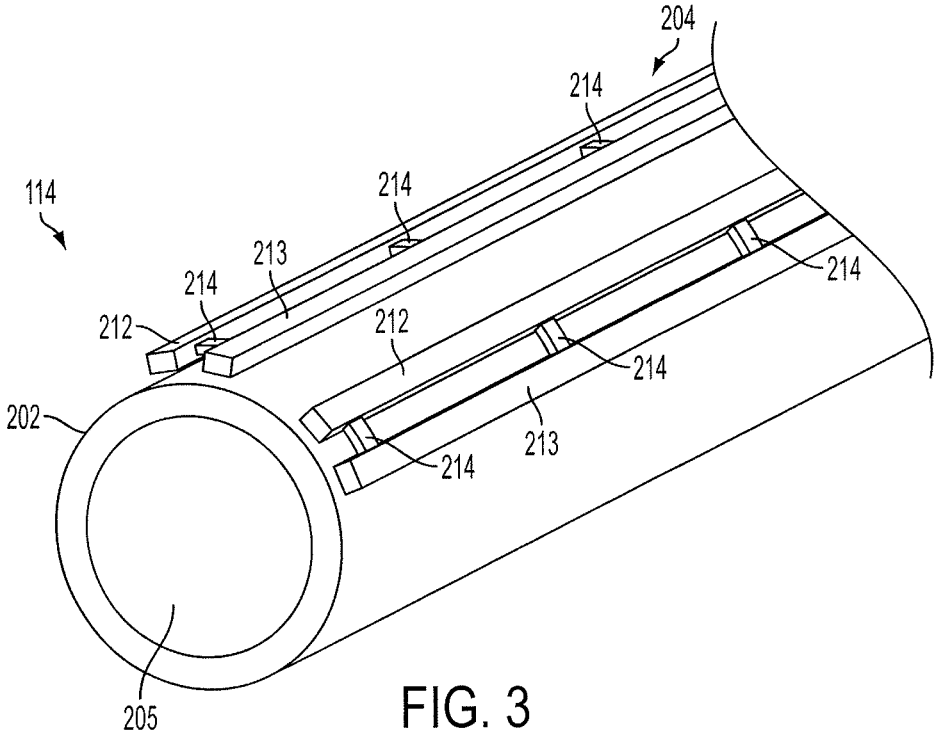
FIG. 3 is a side perspective view of an inflow control device assembly having a shunt tube system according to one embodiment of the present invention.

FIG. 3 shows a perspective view of an inflow control device assembly 114 having a shunt tube system 204. Certain features have been omitted from the present figure for ease of illustration. The shunt tube system 204 comprises a transport tube 212 and a packing tube 213. The packing tube 213 comprises at least one nozzle that can output or deposit gravel slurry from the shunt tube system 204 upon or about the screen 202. The transport tube 212 and the packing tube 213 are positioned exterior to the screen 202.

The packing tube 213 is fluidly connected to the transport tube 212 by conduits 214. Gravel slurry can flow through the transport tube 212 until the gravel slurry reaches a conduit 214 where the gravel slurry can then flows to the packing tube 213. The gravel slurry can flow through the packing tube 213 to the point in which the slurry can exit via a nozzle. In the embodiment shown in FIG. 3, two sets of transport tubes 212 and packing tubes 213 are shown. In other embodiments, a single set of transport tubes 212 and packing tubes 213 can be utilized. In other embodiments, more than two sets of transport tubes and packing tubes can be utilized.

Figure 4:
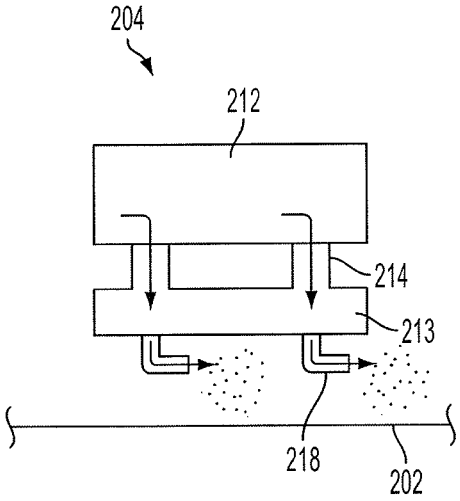
FIG. 4 is a cross-sectional end view of a shunt tube system according to one embodiment of the present invention.

FIG. 4 shows an enlarged cross sectional view of the shunt tube system 204. The transport tube 212 is connected to the packing tube 213 by conduits 214. The packing tube 213 comprises nozzles 218. The arrows show the path in which gravel slurry can flow within the shunt tube system 204. The gravel slurry is transported primarily in the transport tube 212. Upon reaching a conduit 214, the gravel slurry flows through the conduit 214 to the packing tube 213. The gravel slurry exits the packing tube 213 via the nozzles 218 into the annulus between the screen 202 and the wall of the well bore (not shown). As the gravel slurry exits the nozzles 218, the gravel accumulates in the annulus to the point of providing a gravel pack about the screen 202. As the gravel pack is sufficiently packed around one nozzle, the pressure rises and the gravel slurry then flows to the next nozzle or set of nozzles, via the path of least resistance.

The foregoing description of the embodiments, including illustrated embodiments, of the invention has been presented for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. An assembly capable of being installed in a bore of a subterranean formation, the assembly comprising:

a well screen that includes well screen openings;

a flow restricting device for controlling fluid flow through the well screen, the flow restricting device being positioned in a flow path between a port opening to an interior of a base pipe and the well screen openings, the flow path being formed by wires that separate the well screen from the base pipe; and a shunt tube system for providing an alternative path for gravel slurry about the well screen during a gravel packing operation.

2. The assembly of claim 1, wherein the flow restricting device comprises an inflow control device.

3. The assembly of claim 1, wherein the flow restricting device comprises an autonomous valve.

4. The assembly of claim 3, wherein the autonomous valve selectively controls fluid flow during production of the well.

5. The assembly of claim 1, wherein the shunt tube system comprises a transport tube fluidly connected to a packing tube, wherein the gravel slurry exits the shunt tube system through a nozzle in the packing tube.

6. The assembly of claim 1, wherein the shunt tube system comprises at least one nozzle from which the gravel slurry is discharged about the well screen.

7. The assembly of claim 1, wherein the shunt tube system comprises a system capable of gathering carrier fluid.

8. The assembly of claim 7, wherein the system capable of gathering carrier fluid comprises at least one of:

a gravel screening flow channel;

a tube positioned adjacent to the well screen; or a manifold capable of allowing fluid to flow to a fluid sink to allow packing of gravel about the well screen.

9. The assembly of claim 1, wherein the flow restricting device is interconnected in a completion string.

10. The assembly of claim 1, wherein the shunt tube system is connected to the flow restricting device.

11. A well system, comprising:

a flow restricting device positioned in a flow path between a port opening to an interior of a screen base pipe and well screen openings in a screen, the flow restricting being configured for controlling reservoir fluid flow in a deviated well system position, the flow path being formed by wires that separate the well screen from the screen base pipe; and a shunt tube system configured for providing an alternative path for gravel slurry to flow about the screen during a gravel packing operation in the deviated well system position.

12. The well system of claim 11, wherein the flow restricting device is interconnected in a completion string.

13. The well system of claim 11, wherein the flow restricting device comprises an inflow control device.

14. The well system of claim 11, wherein the shunt tube system is connected to the flow restricting device.

15. The well system of claim 11, wherein the flow restricting device comprises an autonomous valve.

16. A method of gravel packing a well, the method comprising:

installing a flow restricting device and a screen in a wellbore, wherein the flow restricting device controls fluid flow into or from a reservoir and is positioned in a flow path between a port opening to an interior of a screen base pipe and screen openings in the screen, the flow path being formed by wires that separate the screen from the screen base pipe; and flowing a gravel slurry about the flow restricting device and the screen, wherein at least a portion of the gravel slurry flows through a shunt tube system providing an alternate path for the gravel slurry to flow along the screen during a gravel packing operation.

17. The method of claim 16, wherein installing a flow restricting device comprises installing a plurality of flow restricting devices in a completion string.

18. The method of claim 16, wherein the flow restricting device comprises an inflow control device.

19. The method of claim 16, wherein the flow restricting comprises an autonomous valve.

20. The assembly of claim 1, wherein the flow restricting device is configured for controlling fluid flow through the well screen in a deviated well system position and the shunt tube system is configured for providing the alternative path for gravel slurry about the well screen during the gravel packing operation in the deviated well system.

* * * * *

UNITED STATES PATENT AND TRADEMARK OFFICE

CERTIFICATE OF CORRECTION

PATENT NO. : 8,833,445 B2
APPLICATION NO. : 13/217869
DATED : September 16, 2014
INVENTOR(S) : Bruce Wallace Techentien et al.

It is certified that error appears in the above-identified patent and that said Letters Patent is hereby corrected as shown below:

In the Specification

In column 2, line 8, delete "rugousity," and insert -- rugosity, --, therefor.

In column 6, line 15, delete "elements" and insert -- devices --, therefor.

In column 8, line 24, delete "118" and insert -- 118. --, therefor.

In the Claims

In column 10, line 49, in claim 11, after "restricting" insert -- device --.

In column 11, line 18, in claim 19, after "restricting" insert -- device --.

Signed and Sealed this
Third Day of February, 2015

Michelle K. Lee

Michelle K. Lee
*Deputy Director of the United States Patent and Trademark Office*